US007472799B2

(12) United States Patent
Cadiente et al.

(10) Patent No.: US 7,472,799 B2
(45) **Date of Patent: *Jan. 6, 2009**

(54) PRODUCE PACKAGING SYSTEM HAVING PRODUCE CONTAINERS WITH DOUBLE-ARCHED BOTTOM VENTILATION CHANNELS

(75) Inventors: Anthony Cadiente, Salinas, CA (US); William K. Sambrailo, Aptos, CA (US); Mark Sambrailo, Watsonville, CA (US)

(73) Assignee: Sambrailo Packaging Inc., Watsonville, CA (US)

( * ) Notice: Subject to any disclaimer, the term of this patent is extended or adjusted under 35 U.S.C. 154(b) by 582 days.

This patent is subject to a terminal disclaimer.

(21) Appl. No.: 11/207,258

(22) Filed: Aug. 18, 2005

(65) Prior Publication Data

US 2006/0027578 A1 Feb. 9, 2006

Related U.S. Application Data

(60) Division of application No. 10/302,059, filed on Nov. 21, 2002, now Pat. No. 6,962,263, and a continuation-in-part of application No. 10/017,893, filed on Dec. 12, 2001, now Pat. No. 7,100,788, which is a continuation-in-part of application No. 09/590,631, filed on Jun. 8, 2000, now abandoned, which is a continuation of application No. 09/060,453, filed on Apr. 14, 1998, now Pat. No. 6,074,676, which is a continuation of application No. 08/591,000, filed on Jan. 24, 1996, now Pat. No. 5,738,890.

(51) Int. Cl.
*B65D 51/16* (2006.01)

(52) U.S. Cl. ..... 220/366.1; 220/608; 220/913

(58) Field of Classification Search ..... 220/4.21, 220/4.22, 4.23, 366.1, 608, 676, 913
See application file for complete search history.

(56) References Cited

U.S. PATENT DOCUMENTS

| | | | |
|---|---|---|---|
| 1,800,346 | A | 4/1931 | Slagel |
| 1,953,765 | A | 4/1934 | McCluney |

(Continued)

FOREIGN PATENT DOCUMENTS

| | | | |
|---|---|---|---|
| DE | 857860 | | 12/1952 |
| GB | 1074164 | | 6/1967 |
| GB | 2160510 | A | 12/1985 |
| GB | 2200340 | A | 8/1988 |
| WO | WO 00/20286 | | 4/2000 |

OTHER PUBLICATIONS

International Search Report and Written Opinion from Corresponding PCT application No. PCT/US06/26170, Jul. 24, 2007, 6 pages.
International Search Report, dated Mar. 12, 2003.
International Search Report, dated Apr. 20, 2004.
International Search Report, dated Jun. 23, 2005.
U.S. Appl. No. 11/177,107, filed Jul. 7, 2005.

*Primary Examiner*—Anthony D Stashick
*Assistant Examiner*—Harry A Grosso
(74) *Attorney, Agent, or Firm*—Beyer Law Group LLP

(57) ABSTRACT

A produce packaging system incorporates a tray for receiving a plurality of produce carrying baskets. The baskets each include upper ventilation slots and lower ventilation channels. The lower ventilation channels are formed by arching the bottoms of the baskets to form transversely oriented channels in the bottoms of the baskets configured to enable bi-directional cooling airflow to pass underneath the baskets in at least two transverse directions. Bi-directional airflow is also achieved in the upper portion of the baskets through the ventilation slots. The trays are configured such that, when the baskets are loaded into the trays, the upper ventilation slots and the lower cooling channels are aligned with sets of cooling vents in the trays thereby facilitating efficient cooling of produce contained in the baskets.

9 Claims, 9 Drawing Sheets

U.S. PATENT DOCUMENTS

| | | | |
|---|---|---|---|
| 2,652,335 | A | 9/1953 | Conti |
| 2,660,529 | A | 11/1953 | Bloom |
| 2,684,907 | A | 7/1954 | Brunsing |
| 2,739,734 | A | 3/1956 | Pugh |
| 2,936,094 | A | 5/1960 | Smith |
| 3,037,658 | A | 6/1962 | Schray et al. |
| 3,042,247 | A | 7/1962 | Bonnet |
| 3,253,762 | A | 5/1966 | Gaunt |
| 3,613,938 | A | 10/1971 | Westcott |
| 3,651,977 | A | 3/1972 | Morgan |
| 3,741,815 | A | 6/1973 | Peterson |
| 3,794,090 | A | 2/1974 | Commisso |
| 3,912,118 | A | 10/1975 | Bird |
| 3,937,389 | A | 2/1976 | Wind |
| 4,206,845 | A | 6/1980 | Christian |
| D256,097 | S | 7/1980 | Amberg |
| 4,390,113 | A | 6/1983 | Bird |
| 4,478,344 | A | 10/1984 | Rehrig |
| D276,216 | S | 11/1984 | Michaud |
| 4,529,088 | A | 7/1985 | Quong |
| 4,570,818 | A | 2/1986 | Borst et al. |
| 4,597,503 | A | 7/1986 | Lates |
| 4,618,069 | A | 10/1986 | Quong |
| 4,664,281 | A | 5/1987 | Falk et al. |
| 4,704,510 | A | 11/1987 | Matsui |
| 4,741,452 | A | 5/1988 | Holzkopf |
| 4,767,008 | A | 8/1988 | Warnecke et al. |
| 4,771,934 | A | 9/1988 | Kalmanides |
| 4,819,822 | A | 4/1989 | Box |
| 4,844,263 | A | 7/1989 | Hadtke |
| 4,859,822 | A | 8/1989 | Ragusa et al. |
| 4,883,195 | A | 11/1989 | Ott et al. |
| 4,974,738 | A | 12/1990 | Kidd et al. |
| D315,100 | S | 3/1991 | Sheehan |
| 5,069,344 | A | 12/1991 | Dehart |
| 5,076,459 | A | 12/1991 | DeHart |
| 5,191,994 | A | 3/1993 | Stauble |
| D339,744 | S | 9/1993 | Seppala |
| 5,265,749 | A | 11/1993 | Zutler |
| D343,576 | S | 1/1994 | Krupa |
| D345,894 | S | 4/1994 | Krupa |
| D348,608 | S | 7/1994 | Wyslotsky |
| 5,339,973 | A | 8/1994 | Edwards et al. |
| D354,436 | S | 1/1995 | Krupa |
| 5,423,453 | A | 6/1995 | Fritz |
| D361,035 | S | 8/1995 | Krupa |
| D361,036 | S | 8/1995 | Krupa |
| D363,022 | S | 10/1995 | Krupa et al. |
| 5,456,379 | A | 10/1995 | Krupa et al. |
| D363,879 | S | 11/1995 | Krupa et al. |
| 5,465,901 | A | 11/1995 | Paine, Jr. |
| 5,515,993 | A | 5/1996 | McManus |
| D376,314 | S | 12/1996 | Krupa |
| D378,192 | S | 2/1997 | Krupa et al. |
| D379,300 | S | 5/1997 | Krupa et al. |
| D380,381 | S | 7/1997 | Krupa et al. |
| D382,795 | S | 8/1997 | Abayhan et al. |
| D385,784 | S | 11/1997 | Krupa et al. |
| 5,686,127 | A | 11/1997 | Stockley, III et al. |
| D393,204 | S | 4/1998 | Goins et al. |
| 5,738,890 | A | 4/1998 | Cadiente et al. |
| 5,803,303 | A | 9/1998 | Timm et al. |
| 5,833,116 | A | 11/1998 | Guillin |
| 5,855,277 | A | 1/1999 | Apps et al. |
| D409,485 | S | 5/1999 | Christy, Jr. |
| 5,947,321 | A | 9/1999 | Vadney |
| 6,007,854 | A | 12/1999 | Cadiente et al. |
| 6,074,676 | A | 6/2000 | Cadiente et al. |
| 6,257,401 | B1 | 7/2001 | Mangla et al. |
| D448,288 | S | 9/2001 | Zettle et al. |
| 6,644,494 | B2 | 11/2003 | Hayes et al. |
| 6,962,263 | B2 | 11/2005 | Cadiente et al. |
| 2003/0198714 | A1 | 10/2003 | Cadiente et al. |

PRODUCE PACKAGING SYSTEM HAVING PRODUCE CONTAINERS WITH DOUBLE-ARCHED BOTTOM VENTILATION CHANNELS

CROSS-REFERENCE TO RELATED PATENT APPLICATIONS

This is a Divisional application of prior U.S. application Ser. No. 10/302,059, entitled "PRODUCE PACKAGING SYSTEM HAVING PRODUCE CONTAINERS WITH DOUBLE-ARCHED BOTTOM VENTILATION CHANNELS, filed on Nov. 21, 2002 now U.S. Pat. No. 6,962,263, which is incorporated herein by reference and from which priority under 35 U.S.C. § 120 is claimed.

This application is a continuation-in-part of application Ser. No. 10/017,893, filed Dec. 12, 2001 now U.S. Pat. No. 7,100,788, which is a continuation-in-part of application Ser. No. 09/590,631, filed Jun. 8, 2000 now abandoned, which is a continuation of application Ser. No. 09/060,453 filed Apr. 14, 1998 and allowed as U.S. Pat. No. 6,074,676, issued on Jun. 13, 2000, which is a continuation of application Ser. No. 08/591,000, filed Jan. 24, 1996 and issued as U.S. Pat. No. 5,738,890 on Apr. 14, 1998, and claims priority from application Ser. No. 10/017,893, filed Dec. 12, 2001.

TECHNICAL FIELD

The present invention relates to apparatus and methods for the improved packing, cooling, storage, and shipping of produce. More particularly, the present invention teaches produce containers with ventilation slots and ventilation channels that are loaded into an improved shipping tray. More particularly still, the present invention enables the flow of cooling air to flow through and underneath the produce containers in more than one direction relative to the container system in order to facilitate improved cooling.

BACKGROUND

Many produce products are harvested and packed in the field into containers, which are ultimately purchased by the end consumer. Examples of such produce items include, but are not limited to, strawberries, raspberries, other berries, tomatoes, grapes, mushrooms, radishes and broccoli florets. Many of these produce items require substantial post-harvest cooling in order to enable shipping over long distances and to prolong shelf life.

In use, a grower's harvesting crew harvests produce items of the type previously discussed directly from the plant in the field into the container. The containers are then loaded into trays, which contain a specific number of individual containers and the trays, when filled, are loaded onto pallets. The most common pallet used in the produce industry in the United States is the forty by forty-eight inch (40"×48") wooden pallet, and the vast majority of produce handling, storage and shipping equipment is designed around pallets of this size.

After the pallets have been filled and loaded in the field, they are transported to shippers who perform a variety of post-harvest processes to enhance the marketability of the produce itself. For many types of produce, including berries, a significant packing evolution is the post-harvest cooling of the packed fruit. Indeed, berry shippers are often referred to as "coolers". The process of cooling berries typically includes injecting a stream of cooling air into one side of a tray and thence through the individual baskets inside the tray and around the berries stored therein. As the air cools the berries, it picks up heat therefrom which is exhausted from apertures on the opposite side of the tray.

A difficulty with such systems is that while they cool the fruit near the outside edges of the trays relatively well, they are less effective at cooling the fruit in the centers of the trays. This problem is exacerbated by placing many trays on a pallet, and then many pallets in a refrigerated transport compartment. The pallet and tray stacking can inhibit the cooling airflow to the extent that the innermost fruit remains relatively warm compared to the cooler outer fruit. This can lead to spoilage in some of the fruit. In order to reduce spoilage, conventional approaches use excessive cooling temperatures to cool the produce. This is relatively effective at cooling the innermost fruit, but is an expensive solution due to higher cooling costs. Additionally, an undesirable consequence of such excess cooling is that the outermost fruit can freeze or nearly freeze resulting in unacceptable product damage. Thus there is a need for a packaging system that can achieve more efficient cooling airflow through the trays and baskets thereby facilitating more even and efficient cooling of produce.

Packages for use by berry coolers have undergone a systematic process of evolution to improve the storing and cooling of the fruit while reducing packaging costs. While early berry packaging products included the use of folded wood or chipboard containers, a common package for the marketing of strawberries for instance, is a one-pound vacuum formed plastic basket developed in conjunction with Michigan State University. This one piece package, hereinafter referred to for brevity as a "Michigan basket", includes a basket body formed with an integral hinged lid which, after the basket is filled with fruit, is folded over and locked in place with respect to the basket body. The lid is retained in position by means of a detent, which engages an edge flange of the basket body. Disposed at or near the substantially flat bottom of the basket body is a plurality of apertures, typically elongate slots, to provide airflow through the body of the packed fruit in the basket. This airflow continues through a similar series of apertures formed in the lid. In the case of the strawberry package, typically, eight (8) sixteen ounce (16 oz) baskets are loaded into a formed and folded corrugated cardboard tray.

The tray developed for use with the Michigan basket has one or more openings along either of its short ends to enable airflow through the tray. From the previous discussion on berry cooling, it will be appreciated that in the typically formed strawberry package system in current use, the two individual baskets within the tray which are immediately adjacent to the air intake apertures formed in the ends of the tray receive substantially more cooling from air inflow than do the two packages at the discharge end of the tray. To overcome this deficiency in air flow, berry coolers are currently required to utilize substantial amounts of cooling energy to ensure that fruit packed at the discharge side of the tray receives sufficient cooling to prolong its shelf life, while precluding the freezing of berries at the intake side of the tray.

The previously discussed problem is due to the fact that the one-pound strawberry baskets, and the trays which now contain them, were developed separately. Specifically, the design of the previously discussed one-pound strawberry basket was finalized prior to the design of the tray, which ultimately receives eight of these baskets therein. The previously discussed one pound strawberry containers in current use measure approximately four and three quarter inches by seven and one quarter inches (4¾"×7¼") and are three and one half inches (3 W) tall with the top secured. As a result, the commonly used eight basket tray measures approximately fifteen and one-half inches by nineteen and three quarters inches (15

W'×19%"). This tray size is to some extent mandated by the size of the baskets it contains. While no great difficulty was likely encountered in forming a tray to fit a given number of the baskets, the area or "footprint" of the resultant tray was not given sufficient consideration in the design of the baskets. This has given rise to a significant inefficiency of packaging.

Because the current eight—one pound strawberry trays, and the baskets shipped therein are not fitted together properly, the package does not fully utilize the surface area of a forty by forty eight inch pallet, therefore shipping of those pallets is not optimized. Specifically, using current basket technology, a layer of strawberries comprises six (6) trays per layer on the pallet. With eight (8) one pound baskets per tray, this means that forty eight pounds of fruit can be packed per layer on a standard 40 inch by 48 inch pallet. Because there is no way with current use packages to completely fill the pallet with trays, a significant portion of the pallet remains unused. This of course forms a further inefficiency of shipping.

Another problem with current use plastic produce baskets is that they are usually formed with vertical stiffening ribs. This is done to maximize the resistance of the relatively thin basket to deformation. These ribs also provide salient intrusions into the body of the basket. Where a pulpy fruit, such as berries, are packed in the basket, handling shock to the packed fruit, combined with the fruit's own weight turns these intrusions into sites where significant bruising of the packed fruit occurs. This loss of fruit quality results in higher costs to the shipper, transporter, retailer and consumer alike.

The previous discussion has centered on the specific case of the one pound whole strawberry container preferred by consumers. It should be noted, however, that while strawberries comprise the bulk of all U.S. berry consumption, other berry crops also enjoy a significant position in the marketplace. Each of these berry crops has, to a certain extent, given rise to preferred packaging embodiments. By way of illustration but not limitation, while strawberries are typically sold in eight ounce or one-pound containers, blueberries are typically sold by volume, specifically, consumers tend to prefer the one pint package of blueberries. Raspberries, on the other hand, are typically marketed in small five or six ounce trays.

The trays into which each of these differing types of berry baskets are ultimately installed have not been designed with a view to integrating them with other berry or indeed other produce crops. This presents a problem to the small-to-medium sized grocery establishment, which may not order berries in multiple pallet lots but may prefer, for various reasons, to mix quantities of berries on one pallet. Because the trays used in the several aspects of the berry industry are not integrated one with another this capability is, at present, not realized. Accordingly, smaller lots of berries as commonly shipped to small-to-medium sized grocers must typically be sold at a premium cost in order to compensate the grower, shipper and transporter for the packing and shipping inefficiencies occasioned by the lack of packaging design cohesion.

Another problem with the previously discussed Michigan basket is the latch, which retains the lid in the closed position with respect to the body. The Michigan basket uses a single detent formed in the lip of the lid to engage the edge of the basket body lip. This latch arrangement has proven troublesome in that it is difficult to quickly and securely close in the field while being prone to unwanted opening during packing, shipping and while on the grocer's shelves.

Other workers in the packaging arts have attempted to solve the previously discussed latch deficiencies by means of forming snap fasteners in the edge material of the plastic baskets, which they produce. The results obtained by this design are mixed. While the snap fasteners may be slightly more secure than the previously discussed edge latch, they are at least as difficult to align properly by pickers in the field as the Michigan basket latch.

The trays currently available for use with Michigan baskets designed for one pound strawberry packing are not generally well suited for the baskets in that the baskets are allowed considerable freedom of movement within the trays. This results in an increased incidence of shifting of the baskets within the trays, which causes an increase in bruising of the fruit stored in the baskets.

Another problem not contemplated by the prior art is that different quantities, types, and external forms of produce require different cooling airflow regimes. Some combinations of fruit types and quantities benefit from the relatively laminar flow provided by the invention of U.S. Pat. No. 5,738,890. Further research has shown that some combinations of produce quantity and type benefit from a relatively turbulent air flow through the basket during the cooling process.

Finally, while the inventions taught and claimed in U.S. Pat. Nos. 5,738,890, 6,074,676, and 6,074,854, incorporated herein by reference, provide hitherto unmatched cooling for produce items, they require that the containers all be aligned alike with respect to the flow of cooling air. See for instance FIG. 8 of U.S. Pat. No. 6,074,854. Where the containers in one layer on a pallet are aligned perpendicular to one another, the flow of cooling air is interrupted. One example of such pallet loading is "5-down" or "10-down", an example of the former being shown at FIG. 8 herewith.

What is clearly needed is an improved berry packing system, which will significantly reduce the cooling time and cooling expense for the fruit contained in the baskets. Moreover, an effective cooling system is needed that facilitates efficient airflow through the trays and baskets of the system in order to maximize air transfer rates. Such a system should result in more uniform cooling in all the fruit in a tray. To make such an improved system feasible, it must interface with commonly used and preferred materials handling apparatus, specifically the previously discussed forty by forty eight inch pallets in current use in the grocery industry. Moreover, where a different pallet size has been adopted as standard, for instance in another country, what is further needed is a system which can be scaled to effect the advantages hereof in that pallet system.

The baskets of such a system should be capable of being formed in the preferred size or quantity configuration preferred by the end consumer, while simultaneously maximizing their footprint on existing pallet technology. The baskets should be formed to minimize bruising and other damage to the fruit packed therein. Furthermore, such a system should provide for the mixing of lots of different types, quantities and sizes of produce on a single pallet without substantial losses of packaging efficiency occasioned by differing types of misaligned trays.

The basket should possess a lid latch capable of being quickly and securely fastened in the field. The same lid should be capable of being repeatedly opened and closed during packing, while on the grocer's shelves and ultimately by the end consumer. Moreover, the basket should be configured to reduce the chances that a basket crushes produce contained therein as a result of improperly closing a basket.

The packaging system should enable the packaging of one layer, or a plurality of layers of filled baskets therein.

The several components of the packaging system should be capable of providing cooling airflow regimes relatively optimal for the type and quantity of produce to be stored in the baskets.

Finally, the system should enable the placement of trays substantially perpendicular with one another while still enabling the previously discussed cooling advantages.

If possible, the system should be formed utilizing existing equipment and machinery from materials of the same or lesser cost than currently available fruit packages.

SUMMARY OF THE INVENTION

In accordance with the principles of the present invention, produce packaging systems are disclosed. Implementations of the present invention include, without limitation, packaging systems such as the Mixim™, MiximPlus™, Mixim5D™ or Mixim 10D™ packaging systems, each available from Sambrailo Packaging or Plexiform Inc., both of Watsonville, Calif., which system comprises an improved produce packing system which matches trays with baskets to significantly reduce cooling time and expense for the fruit contained in the baskets.

Embodiments of the invention include a system for packaging produce. The system includes a plurality of specifically constructed baskets loaded into an associated tray. The baskets each comprise a basket body with a lid. The baskets also include ventilation slots arranged to facilitate the flow of cooling air through the baskets in at least two transverse directions. Further, the baskets include ventilation channels arranged to facilitate the flow of cooling air underneath the baskets in at least two transverse directions. The associated tray is suitably configured to hold the baskets in a manner that enables the flow of the cooling air through and underneath the baskets in at least two transverse directions. In order to accomplish this, the tray includes upper cooling vents arranged to align with the ventilation slots in the baskets. Also, the tray includes lower cooling vents arranged to align with ventilation channels of the baskets. This enables cooling air to flow through the tray, and baskets contained therein, in two (or more) transverse directions.

In another embodiment, the invention discloses a produce container capable of facilitating cooling airflows both underneath and through the container. Moreover, the container facilitates the flow of the cooling air in at least two transversely oriented directions. The containers include a produce basket having a basket body and a lid for covering the basket body. Each basket also includes a plurality of ventilation slots and a plurality of ventilation channels that are formed in the basket to facilitate the flow of cooling air through the baskets and underneath the baskets.

Embodiments of the invention also include trays incorporating the principles of the invention. For example, one tray in accordance with the principles of the invention contains a plurality of produce baskets, with the baskets including a plurality of ventilation slots and a plurality of ventilation channels. The tray is configured to hold the baskets so that flows of cooling air pass through and underneath the baskets in at least two transverse directions. In one implementation, the tray includes upper cooling vents arranged so that the upper cooling vents align with ventilation slots of baskets loaded into the tray. The tray also includes lower cooling vents arranged to align with ventilation channels of the baskets loaded into the tray.

In another embodiment, a basket includes a basket body and lid. The basket includes a latch for securing the lid to the basket body. Additionally, the basket includes a hinge for attaching the lid to the basket body so that, when closed, the hinge applies tension at the hinge to prevent the lid from extending beyond an outside edge of the basket body and thereby prevents the latch from improperly securing the lid to the basket body.

These and other aspects of the present invention are described in greater detail in the detailed description of the invention set forth herein below.

BRIEF DESCRIPTION OF THE DRAWINGS

The following detailed description will be more readily understood in conjunction with the accompanying drawings, in which.

It is to be understood that, in the drawings, like reference numerals designate like structural elements. Also, it is understood that the depictions in the Figures are not necessarily to scale.

DETAILED DESCRIPTION OF THE INVENTION

The present invention has been particularly shown and described with respect to certain embodiments and specific features thereof. The embodiments set forth herein below are to be taken as illustrative rather than limiting. It should be readily apparent to those of ordinary skill in the art that various changes and modifications in form and detail may be made without departing from the spirit and scope of the invention.

Figure 1:
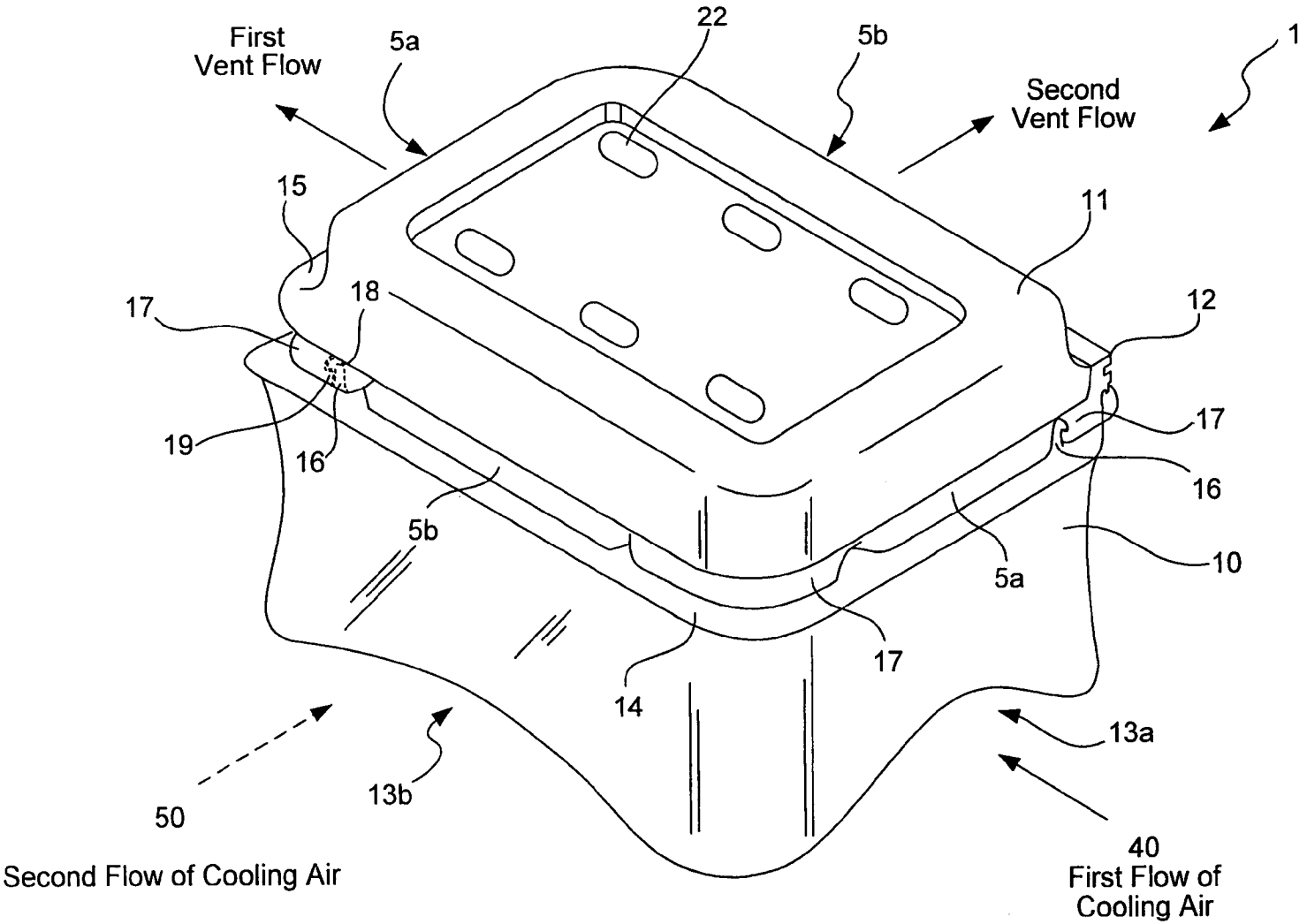
FIG. 1 is a perspective view of one closed produce basket embodiment according to the principles of the present invention.

Having reference to FIG. 1, a first preferred embodiment of the produce basket 1 of the present invention is shown. Produce basket 1 is a one-piece structure incorporating both basket body 10 and lid 11. That portion of produce basket 1 joining basket body 10 and lid 11 is formed as a hinge, 12. The basket body 10 further includes a concavity formed in the bottom portion of the basket body 10. This concavity defines a first ventilation channel 13*a*. In the depicted embodiment, the first ventilation channel 13*a* extends longitudinally along the long axis of the basket body 10. This first ventilation channel 13*a* enables a portion of the first cooling airflow (passing in the direction indicated by the associated arrow) to pass a cooling airflow underneath the basket 1 to enhance cooling.

Additionally, the basket body 10 includes another concavity formed in the bottom portion of the basket body 10. This concavity defines a second ventilation channel 13*b*. The second ventilation channel 13*b* is arranged transversely with respect to the first ventilation channel 13*a*. In the depicted embodiment, the second ventilation channel 13*b* extends in a direction that is perpendicular to the first ventilation channel 13*a*. As a result, the second ventilation channel 13*b* enables a portion of the second cooling airflow (passing in the direction indicated by the associated dashed arrow 50) to pass another cooling airflow underneath the basket 1 to enhance cooling. Thus, two transversely directed airflows can pass underneath the basket 1 to greatly enhance cooling effectiveness. This is especially so in view of the fact that portions of the first cooling airflow and second cooling airflow pass through a first ventilation slot 5*a* and a second ventilation slot 5*b*, respectively.

While this first preferred embodiment is a vacuum formed plastic structure, the principles of the present invention are equally applicable to alternative materials and manufacturing technologies. In the depicted embodiment, the basket is formed of a PET material such as Copolyester 9921, available from Eastman Kodak. Alternative materials include, but are not limited to, various polymeric and monomeric plastics including, but not limited to, styrenes, polyethylenes (including HDPE and LPDE), polyesters, and polyurethanes; metals and foils thereof; paper products including chipboard, pressboard, and flakeboard; wood and combinations of the foregoing. Alternative manufacturing technologies include, but are again not limited to, thermocasting; casting, including die-casting; thermosetting; extrusion; sintering; lamination; the use of built-up structures and other processes well known to those of ordinary skill in the art.

Figure 2:
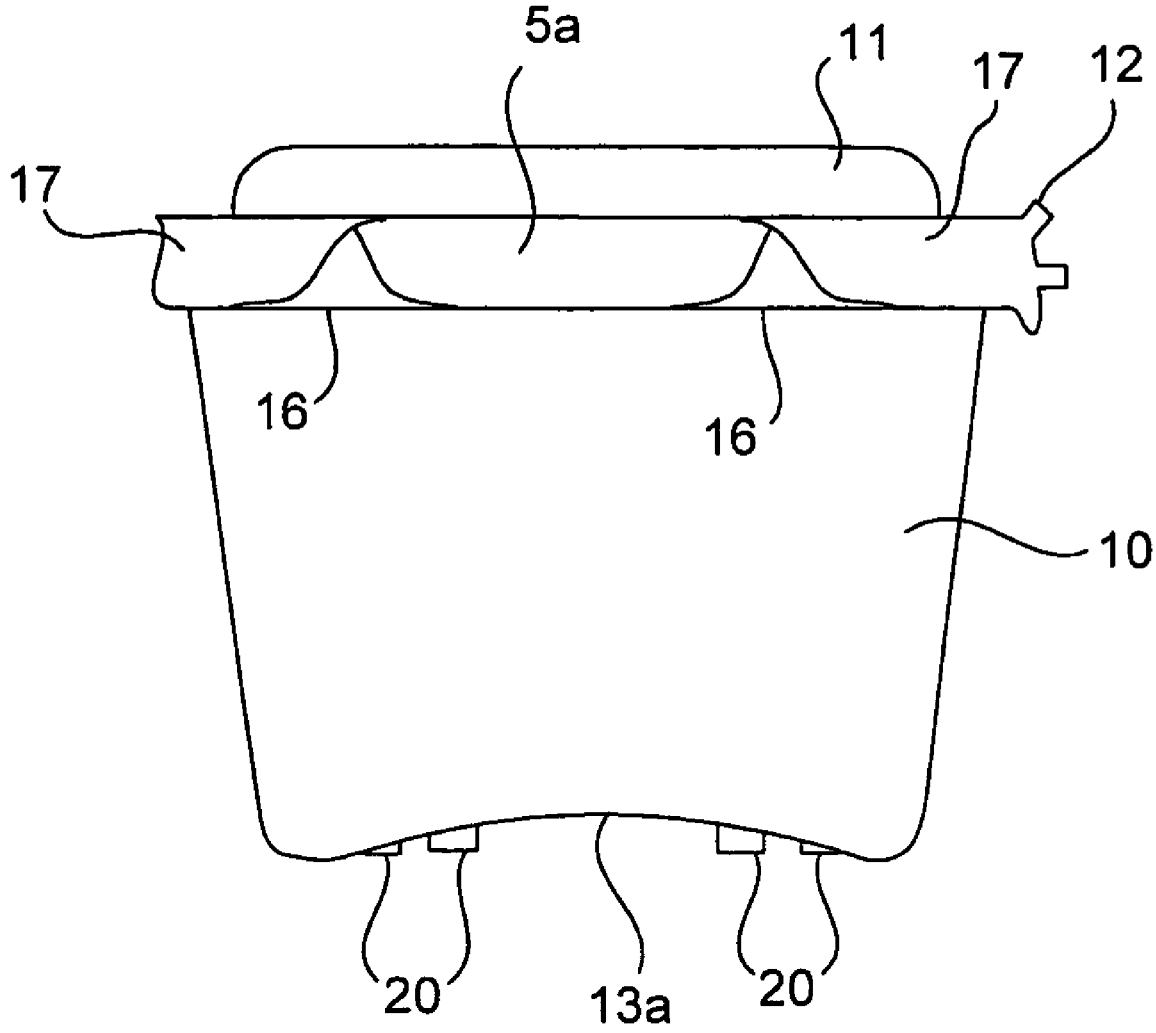
FIG. 2 is an end view of the closed produce basket shown in FIG. 1.
Figure 3:
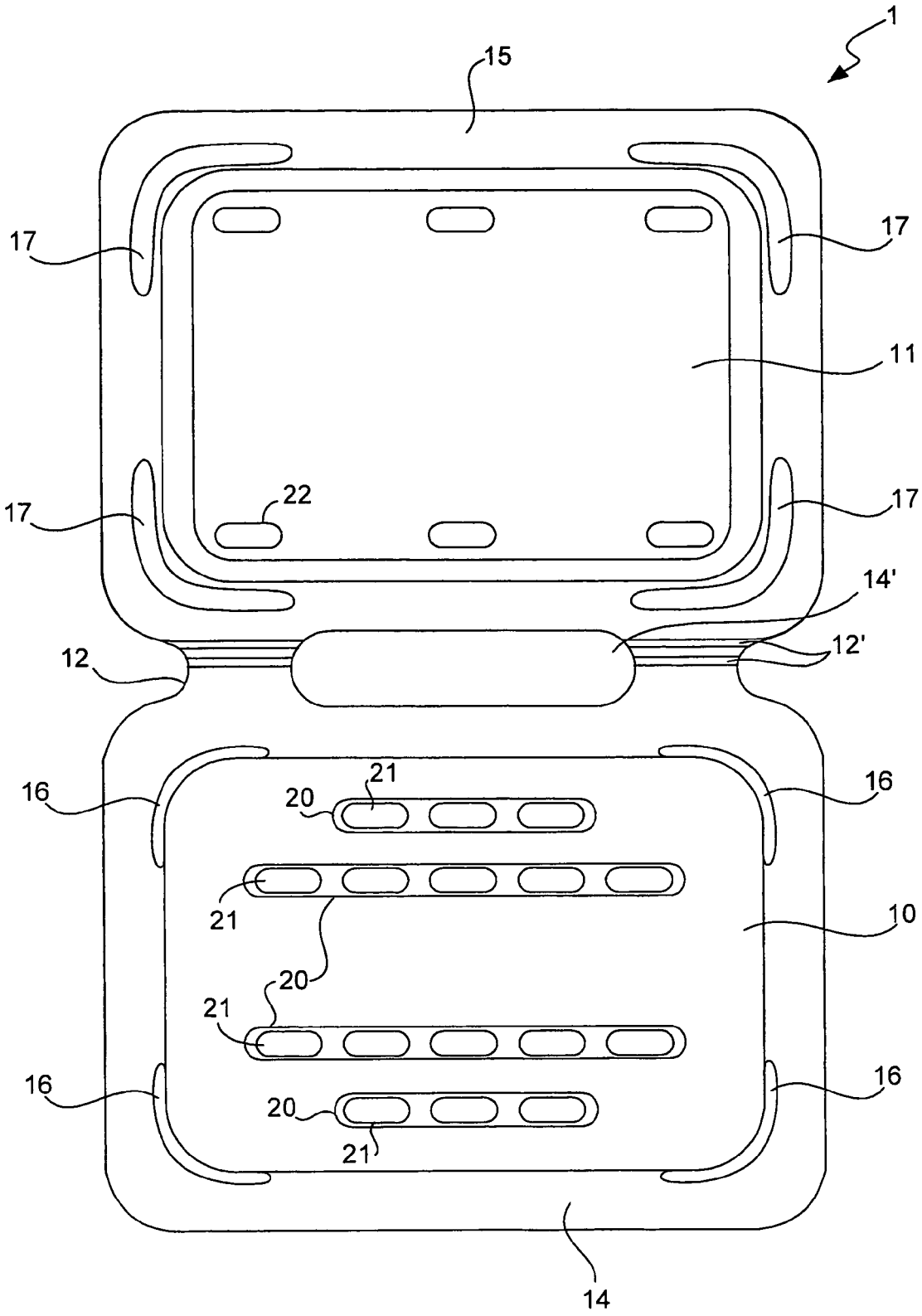
FIG. 3 is plan view of the open produce basket shown in FIG. 1.

With continuing reference to FIG. 1 and also now having reference to FIGS. 2 and 3, some of the improved ventilation features of this first preferred embodiment of the present invention are shown. Lateral (e.g., first) ventilation channel 13*a* is formed at a substantially lower portion of body 10. Channel 13*a* is disposed on body 10 to provide an improved flow of cooling air and ventilation through the lower portion of body 10. To enhance this effect, some embodiments include at least one, and preferably a plurality of ventilation openings (not shown here) within vent bosses 20. In order to provide a similarly improved flow of cooling air and ventilation through the upper portion of basket body 10, a first set of ventilation slots 5*a* are defined when lid 11 and body 10 are secured together. Slots 5*a* are maintained at a fixed distance by latches (depicted here as paired detent latches 16 and 17). The flow of cooling air through the basket 1 can be further improved by at least one, and again preferably a plurality of upper ventilation openings 22 in the upper surface of lid 11. A second set of ventilation slots 5*b* are also formed when lid 11 and body 10 are secured together. In the depicted embodiment, the second set of ventilation slots 5*b* are positioned perpendicular to the first set of ventilation slots 5*a*. Such an arrangement enables a portion of the second flow of cooling air to enter, and flow through, the basket 1 in a direction transverse to that of the first flow of cooling air. In some embodiments, it is intended that these transverse airflows be in a direction substantially perpendicular from one another.

With reference to FIG. 3, a hinge 12 is depicted as connecting the lid 11 to the basket body 10. An opening 14' in the hinge defines one ventilation slot of the second set of ventilation slots 5*b* when the lid 11 is closed onto the body 10. In the depicted embodiment, the hinge 12 also features tensioning grooves 12'. These tensioning grooves 12' serve to apply a tension on the lid 11 that reduces the likelihood that the lid 11 will be improperly closed during field loading. As a result, less produce will suffer damage from loose, improperly closed lids 11 being crushed down on the produce contained in the basket body 10. Also, in one embodiment, the tension applied by the grooves 12' in the hinge 12 exerts a pressure on the upper detent latch 17 that more firmly engages the bottom detent latch 16. As a result, the tension exerted by the grooves 12' in the hinge 12 helps keep the baskets 1 closed during ordinary handling.

The upper and lower vent apertures, 22 and 21 are clearly shown in FIG. 3. Also depicted is a general arrangement of a latch embodiment having detent latches 16 and 17. In the depicted embodiment, lower latches 16 are disposed about a substantially inner portion of lower lip 14, while upper latches 17 are disposed about a substantially outer portion of upper lip 15. In this manner, when lid 11 is secured to body 10, lower latches 16 are substantially captured within upper latches 17, and maintained in an engaged configuration by the elastic deformation of latches 16 and 17 in operative combination with teeth 18 and 19 (not shown in this figure). In some embodiments, this engagement is enhanced by the presence of the tensioning grooves 12' in the hinge 12. Furthermore, latches 16 and 17 (e.g., latches disposed about the portions of body 10 and lid 11 immediately adjacent to hinge 12) substantially preclude lateral movement and potential disengagement of lid 11 from body 10.

With continued reference to FIG. 3, it will be apparent that in closing lid 11 onto body 10, latches 16 and 17 disposed about the portions of body 10 and lid 11 immediately adjacent to hinge 12 will be the first to engage as lid 11 is closed. After teeth 18 and 19 (not shown in this figure) of this latch pair engage, the act of closing lid 11 continues, and latches 16 and 17 at the front end of basket 1 are engaged. The operator, by applying further closing pressure, elastically deforms to some degree at least some of latches 16 and 17, engaging teeth 18 and 19 (not shown in this figure) and thereby securing lid 11 onto body 10. Additionally, the tension supplied by the tensioning grooves 12' further acts to maintain secure engagement of the lid 11 to the body 10.

While the preceding discussion regarding a first preferred embodiment has centered on a one piece basket incorporating the basket body and lid joined by a hinge, it will be immediately apparent to those of ordinary skill in the art that the principles of the present invention may with equal facility be embodied in a two piece implementation utilizing a separate body and lid. This embodiment is specifically contemplated by the teachings of the present invention.

While the previously discussed latch configuration has been shown to be particularly effective, the principles of the present invention specifically contemplate alternative latching methodologies. These include, but are specifically not limited to, edge catches, button catches, snaps, hook-and-loop closures, and other closure methodologies well-known to those having ordinary skill in the art. Moreover, the term "latch" as used herein may further comprise alternative lid closure methodologies known to those having ordinary skill in the art including shrink-wrap banding the lid to the body, and the use of elastic bands or adhesive tapes to perform this latching function. One basket formed utilizing such an alternative closure methodology is shown having reference to FIG. 3A.

Figure 3A:
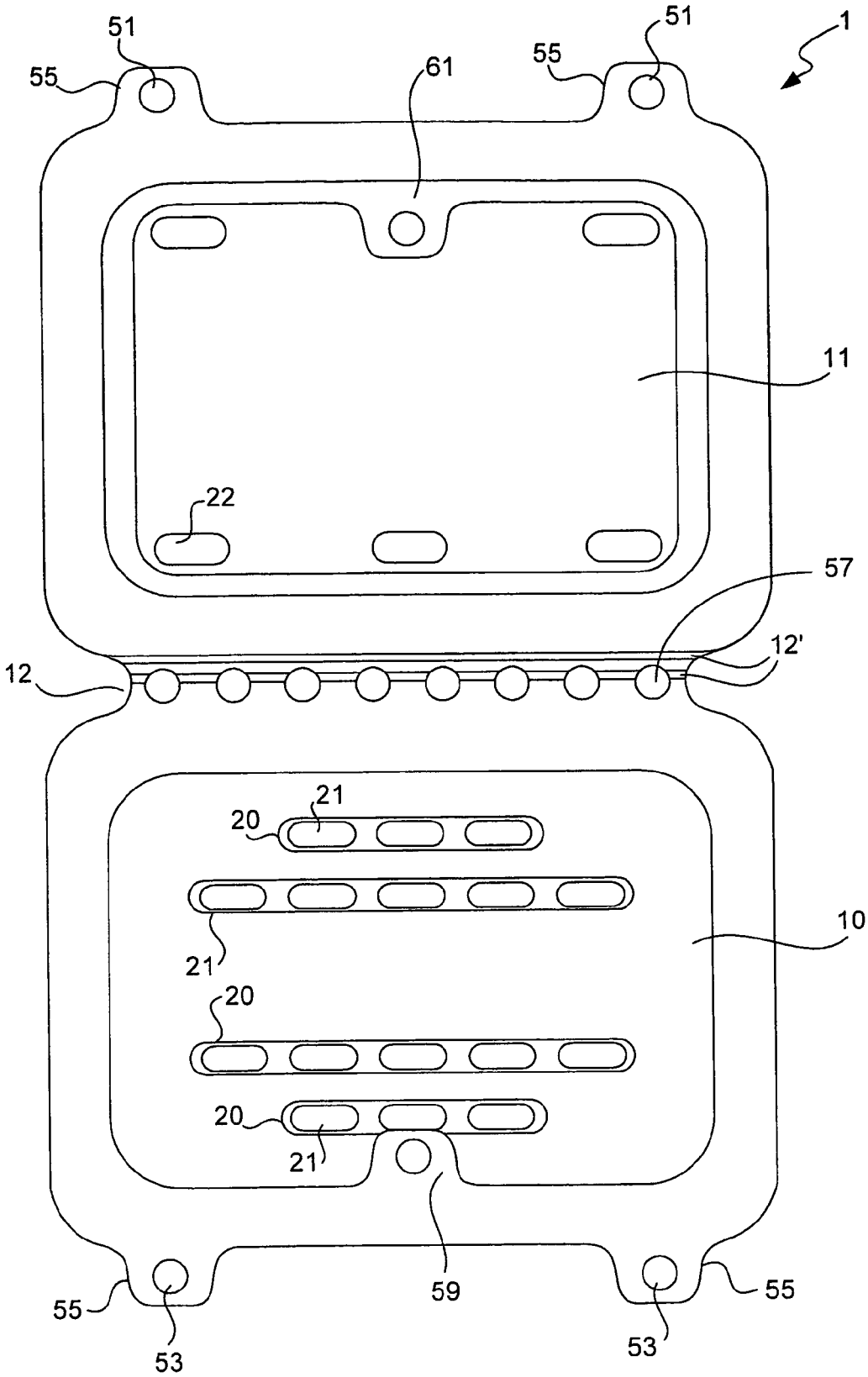
FIG. 3A is a plan view of an alternative embodiment of an open produce basket illustrating an alternative hinge design and alternative latches.

FIG. 3A further discloses an alternative to the single aperture 14' shown in FIG. 3. According to this aspect of the present invention, the single aperture 14' may be replaced by a plurality of smaller apertures 57 defined across the vertical aspect of hinge 12. The present invention specifically contemplates a number of geometries for both aperture 14' and apertures 57. These include, but are specifically not limited to, circles, oblongs, squares, rectangles, polygons, and figures. Examples of the latter may include letters, numerals, and geometric or cartoon shapes. When the lid 11 is closed on the body 10, the plurality of apertures 57 defines ventilation slots of the second set of ventilation slots 5*b*. Thus, the plurality of apertures 57 facilitates the second flow of cooling air to pass through the basket 1.

Also shown in FIG. 3A is the use of a median catch for precluding lateral motion between basket body 10 and lid 11. It has been found that when large baskets are handled, for instance the large baskets used for multiple-pound industrial packs of strawberries, it is often advantageous to provide a methodology for precluding the lateral movement of lid 11 with respect to basket body 10. One methodology of precluding this unwanted movement is the placement of a button catch, for instance the button catch defined by pairs 59 and 61, at some point between latch pairs 51 and 53. In order to provide the requisite compression strength to enable securing this median button catch (defined by 59 and 61), one or both of button catch members 59 and 61 may be advantageously mounted on a pilaster formed in one or both of basket body 10 and basket lid 11.

Figure 3B:
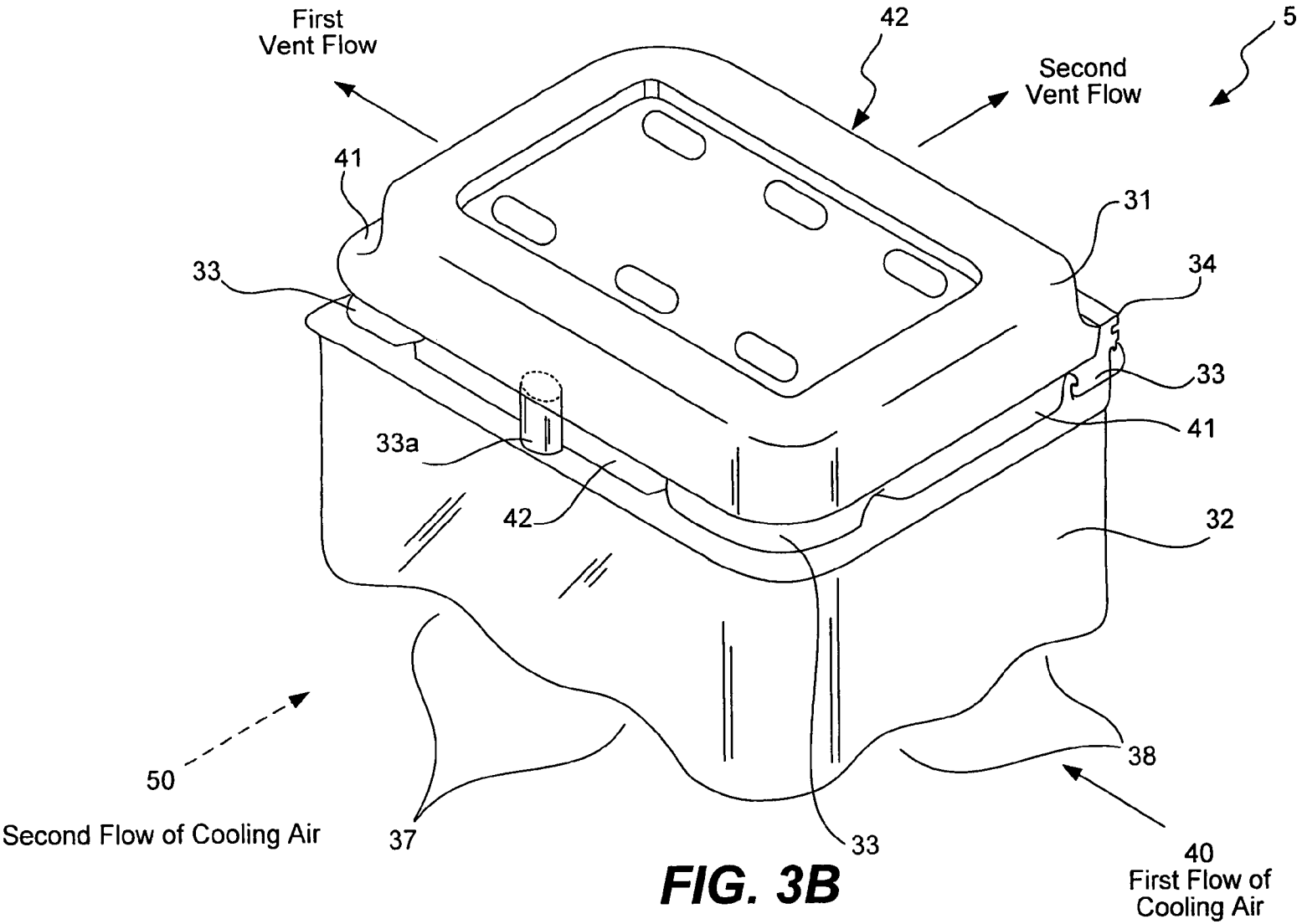
FIG. 3B is a plan view of another alternative embodiment of a basket illustrating an alternative ventilation channel configuration.

FIG. 3B depicts an alternative basket embodiment. The basket 5 of FIG. 3B is substantially larger than the previously disclosed embodiments. Such baskets 5 can, for example, be used to hold two pounds of produce. Due to the larger size and weight, certain adjustments can be made in the basket. As with the previously discussed embodiments, the basket 5 includes a lid 31 and basket body 32. As with other embodiments, the basket 5 can be secured using latches 33 and can include a hinge 34. Also, a first set of ventilation slots 41 is formed in an upper portion of the basket 5 to facilitate cooling flow from the first flow of cooling air 40 through the basket 5. A second set of ventilation slots 42 is formed in an upper portion of the basket 5 to facilitate cooling flow from the second flow of cooling air 50 through the basket 5. Although not directly shown in this view, the second set of ventilation slots 42 can include one or more apertures in the hinge 34. In the depicted embodiment, the front facing ventilation slot (comprising one of the second set of ventilation slots 42) includes a button latch 33*a*. The button latch 33*a* can be incorporated for added strength and to better secure the lid 31 to the body 32. A significant aspect of the embodiment concerns the lower portion of the basket 5. In the depicted embodiment, the cooling flow can be passed underneath the basket 5 using a plurality of first ventilation channels 38. Although depicted here with two ventilation channels 38, more can be implemented. These first ventilation channels 38 facilitate the efficient passage of the first cooling flow 40 underneath the basket 5. Similarly, a second plurality of ventilation channels 37 are used to facilitate the flow of a transversely directed second cooling flow of air 50 as it passes underneath the basket 5. Typically, the first ventilation channels 38 are perpendicular to the second ventilation channels 37. The inventors contemplate many related embodiments including, but not limited to, embodiments having two, three, or more ventilation channels.

Figure 4:
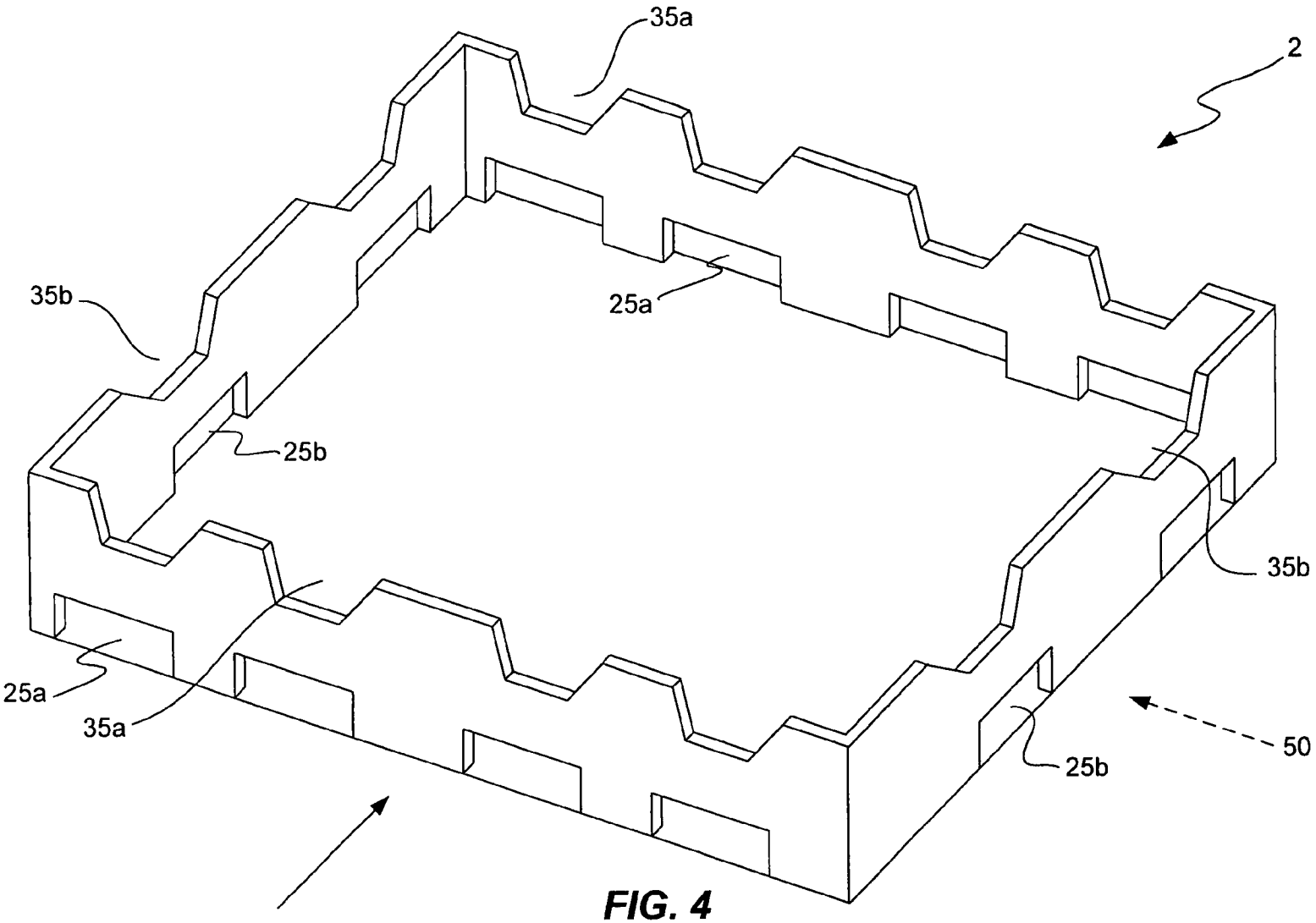
FIG. 4 is a perspective view of one tray implementation constructed in accordance with the principles of the present invention.
Figure 5:
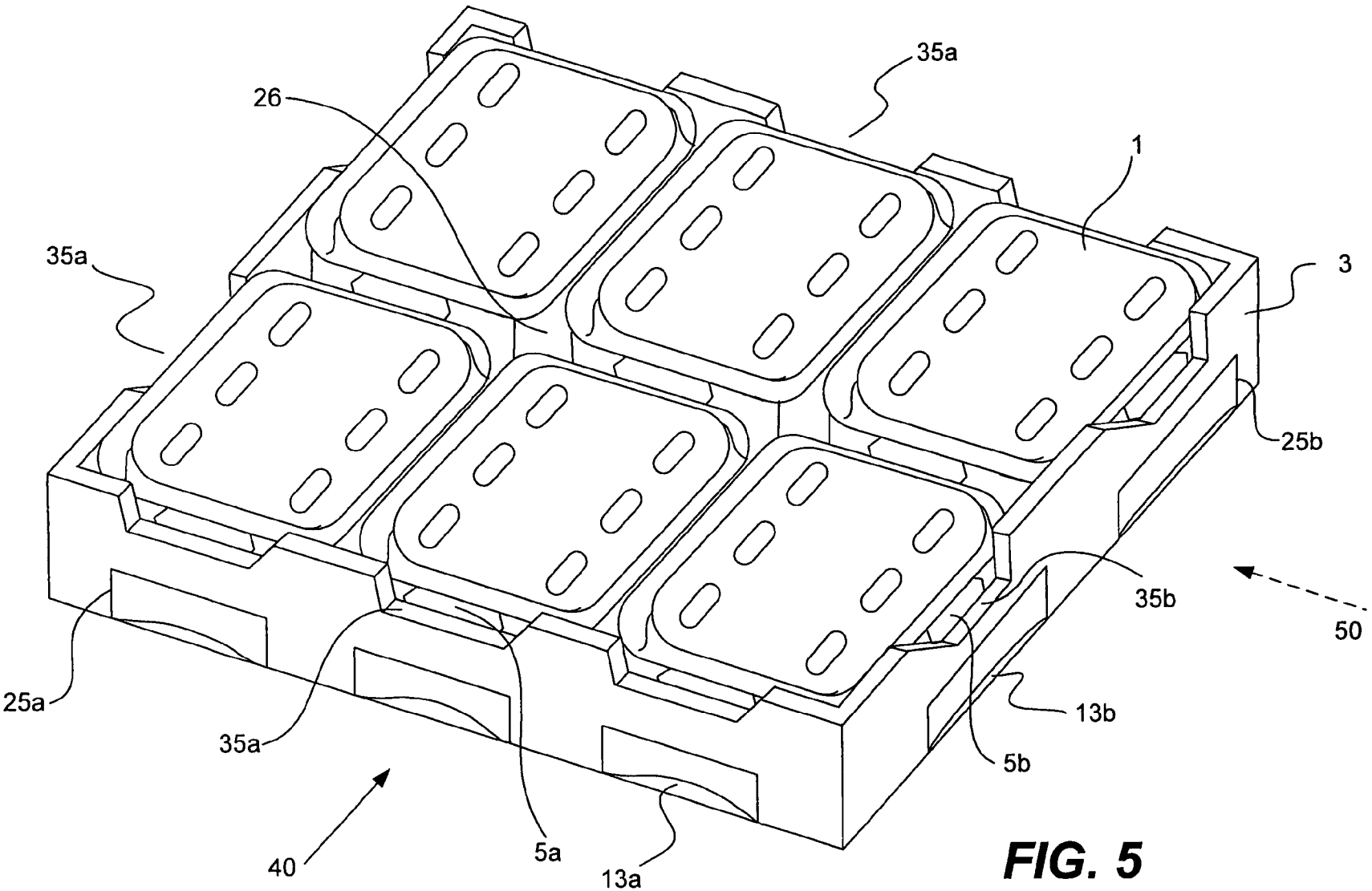
FIG. 5 is a perspective view of an alternative tray implementation having a plurality of closed produce baskets loaded into the tray as taught by the present invention.

FIGS. 4 and 5, depict related tray embodiments, formed according to the principles of the present invention. The trays are sized to hold at least one, and preferably, a plurality of baskets (not shown in FIG. 4). In one preferred embodiment of the present invention, tray 2 holds eight baskets 1. A particular feature of tray 2 is the plurality of lower tray vents 25*a* and 25*b*. A first set of lower tray vents 25*a* enables a cooling flow to pass along the bottom of the tray in a first cooling direction 40 (shown here with the arrow). Moreover, a second set of lower tray vents 25*b* enables a second cooling flow to pass along the bottom of the tray in a second cooling direction 50 (shown here with the dashed arrow). The first lower tray vents 25*a* are intended to align with the first ventilation channels 13*a* of the previously discussed baskets (e.g., FIG. 1). Similarly, the lower tray vents 25*b* are intended to align with the second ventilation channels 13*b* of the previously discussed baskets. Another particular feature of tray 2 is the plurality of upper tray vents 35*a* and 35*b*. A first set of upper tray vents 35*a* enables a cooling flow to pass through baskets in a first cooling direction 40 (shown here with the arrow). Moreover, a second set of upper tray vents 35*b* enables a second cooling flow to pass through baskets in a second cooling direction 50 (shown here with the dashed arrow). The first upper tray vents 35*a* are intended to align with the first ventilation slots 5*a* of the previously discussed baskets (e.g., FIG. 1). Similarly, the upper tray vents 35*b* are intended to align with the second ventilation slots 5*b* of the previously discussed baskets. In this way the embodiment provides excellent cooling flow throughout the many baskets loaded into the tray. In one alternative implementation, tray 2 can be constructed so that, for example, the first set of upper tray vents 35*a* can comprise only one extended length vent on each side of the tray. Such an embodiment can provide the needed cooling air flow through the baskets. Such an embodiment has the advantage of being simpler to manufacture and therefore may be preferred for some implementations.

FIG. 5 depicts a slightly different tray 3 embodiment than that of FIG. 4, but the essential principles are the same. In the depicted embodiment, a plurality of closed baskets 1 (six baskets 1 are depicted here) is loaded into the tray 3. In the bottom portion of the tray 3, tray vents 25*a* and 25*b* align with the previously discussed ventilation channels formed in the bottom of baskets 1. As shown here, a first set of lower tray vents 25*a* is aligned with ventilation channels 13*a* of the baskets 1. In the depicted embodiment, the tray includes a first set of lower tray vents 25*a* having six vents 25*a* (three on each side of the tray). Similarly, a second set of lower tray vents 25*b* is aligned with ventilation channels 13*b* of the baskets 1. The depicted tray includes a second set of lower tray vents 25*b* having four vents 25*b* (two on each side of the tray). Additionally, the upper portion of the tray 3 includes tray vents 35*a* and 35*b* that are aligned with the previously discussed ventilation slots of the baskets 1. As shown here, a first set of upper tray vents 35*a* is aligned with ventilation slots 5*a* of the baskets 1. The depicted tray includes six vents 35*a* (three on each side of the tray). Similarly, a second set of upper tray vents 35*b* is aligned with ventilation slots 5*b* of the baskets 1. Here the tray includes four vents 35*b* (two on each side of the tray). In this manner, a number of direct paths are created from the ambient atmosphere to the bottom surface of each basket 1 and through upper portions of the baskets loaded into tray 3.

Additionally, when trays 3 (and also other embodiments, e.g., 2) are stacked together (e.g., on a pallet), lateral vent slots 26 are formed between each pair of trays 3. These lateral vent slots 26 can provide additional airflow inside trays 3. These improvements in basket ventilation combine to ensure that all berries in the tray receive significantly greater cooling ventilation than any previous fruit cooling and packaging system. As a result, the cooling energy requirements for such systems are greatly reduced. Indeed, preliminary testing indicates that the improved cooling afforded by the ventilation arrangement of the present invention may cut cooling costs for some strawberry packing operations by as much as 25%. Additionally, by implementing a bi-directional cooling regime (e.g. applying a first cooling flow 40 and a second cooling flow 50), such trays 3 with appropriately loaded baskets 1 exhibit very high cooling flow through the trays 3 (and baskets 1).

Cooling flows on the order of 1.0 c.f.m. (cubic feet per minute) or greater through the trays are difficult to obtain with existing technologies. Such cooling flows are highly desirable. One illustration of the advantages of the embodiments of the present invention is that cooling flows in the range of about 1.5 c.p.m. to about 2.6 c.p.m. can be obtained. This is especially true with respect to the tray 2 embodiment of FIG. 4. These advantages are further enjoyed when these tray embodiments are stacked on pallets. Where adjacent trays (e.g., 2 or 3) are arranged perpendicularly to each other, for instance on a pallet, the lower vents 25*a* of one tray align with lower vents 25*b* of an adjacent (perpendicularly positioned) tray to enable the previously described cooling flows to pass through trays (and underneath the baskets) which are positioned perpendicular to one another. Additionally, the trays are configured such that upper vents 35*a* of one tray align with upper vents 35*b* of an adjacent (perpendicularly positioned) tray to enable the previously described cooling flows to pass through trays (and through the slots of the baskets) in an efficient cooling flow. More advantageously, these cooling flows can be passed through the trays (and baskets) in at least two directions.

Figure 6:
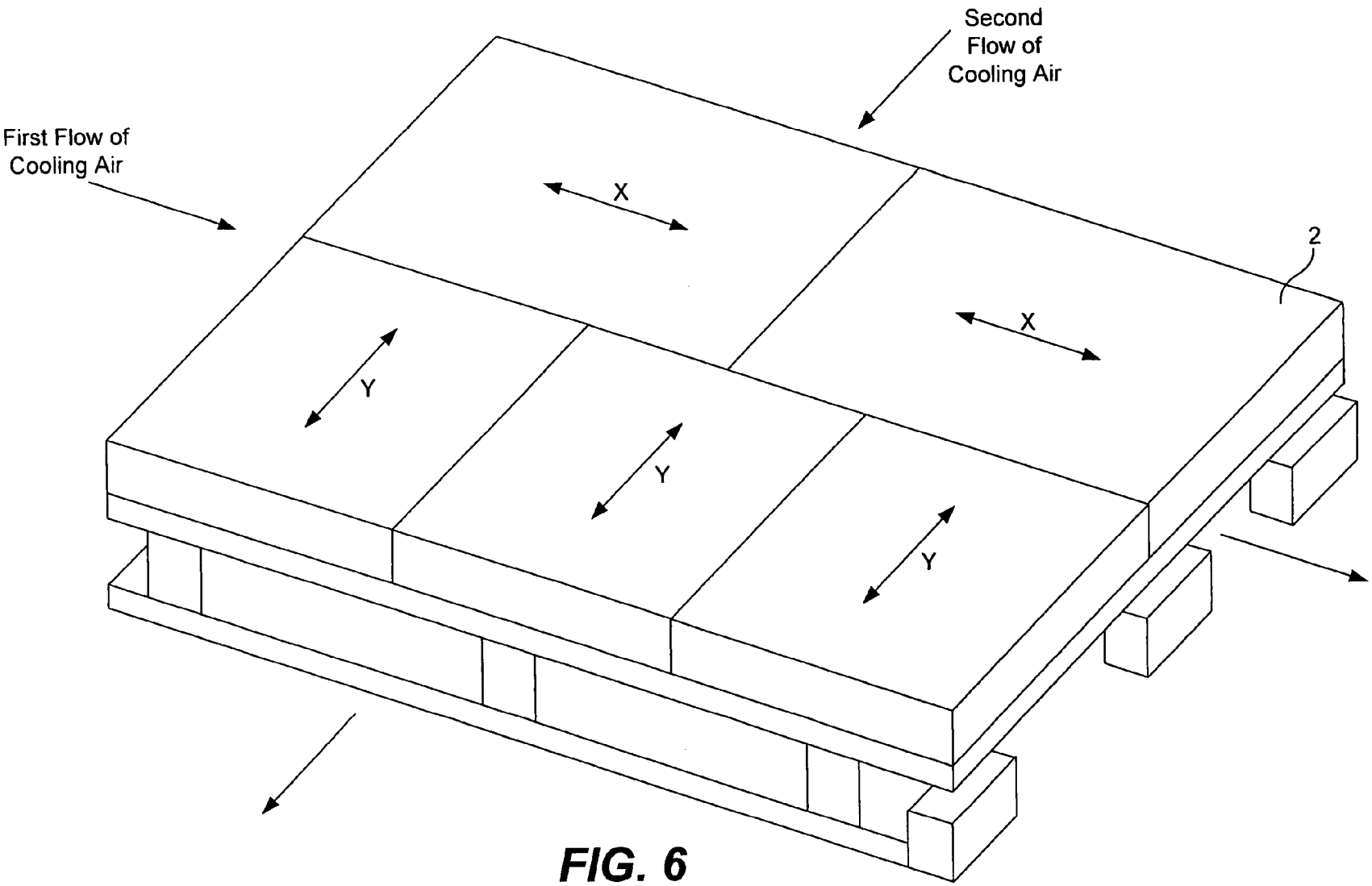
FIG. 6 is a perspective view of a plurality of trays of the present invention shown loaded on a pallet in a 5-down configuration.

Having reference now to FIG. 6, a significant savings in shipping costs is realized by sizing baskets 1 and trays 2 as a system to maximize the area or shipping footprint of a layer of trays on a pallet. As previously discussed, the 40" (inch) by 48" pallet is the preferred standard size in the grocery business in the United States. Current Michigan baskets measure approximately 4¾" by 7¼" by 3 W tall when closed and are loaded eight per tray. This tray measures approximately 19¾" by 15%". A maximum of six such trays constitute a layer on a 40" by 48" pallet. Where the trays are loaded with one pound strawberry baskets, a maximum of 48 pounds of fruit may thus be loaded in each layer. In contrast, baskets of the present invention designed to receive therein one pound of strawberries are sized approximately 6⅜"×5"×3% high, when closed. One embodiment of tray 2 is sized at approximately 16"×13'/4". This size maximizes the footprint on a standard pallet. This means that nine such trays can be loaded as a layer on the previously described pallet, for a total of 54 pounds of fruit per layer. This represents an increase of 6 pounds, or 16 percent per layer over the Michigan basket. Since the shipper is not paying for wasted shipping volume, his shipping costs are reduced, which can result in further savings to the consumer. Moreover, the sizing of baskets and trays may be optimized to effect the "5-down" stacking shown in FIG. 6.

The preceding discussion of a first preferred embodiment of the present invention has focused on one specific berry package design. It will be immediately obvious to those of ordinary skill in the art that the principles set forth herein are also applicable to a wide range of produce package sizes and utilizations. By way of illustration but not limitation, the present invention specifically contemplates the forming of 1 pint and ½ pint (also referred to as 8 oz. or 250 g.) berry baskets, as well as baskets configured to receive therein specific produce shapes, types and counts. An example of the latter is the "long stem pack" used in the berry industry for shipping specific package counts of large, premium berries. Furthermore, while the discussion of the principles set forth herein has centered on packages for the berry industry, it is recognized that these principles may be applied with equal facility to the packaging of a broad range of materials including other foodstuffs or any item, which would benefit from the advantages set forth herein. Such applications are specifically contemplated. These principles include the use of a family of trays, having fixed "footprints" or lengths and widths, but with whose heights are varied to accommodate baskets having different heights and/or counts per tray. By maintaining the footprint at a constant value, the advantages of minimizing lateral movement between individual trays and between layers of trays are attained because the trays of one layer interlock with the layer of trays above or below it. This is true even where adjacent tray layers contain significantly differing sizes of baskets, holding the same or different produce items.

Where the tray is designed to receive one pound strawberry baskets as previously discussed, the height of the tray is approximately 3¾ inches. Where other berries, or indeed other produce products are shipped, the length and width of the tray do not change, but remain at the previously defined optimal size. Changes in tray volume necessary to accommodate differing numbers and volumes of baskets are accommodated by altering the height of the tray. In similar fashion, baskets designed for use in the present system are sized to fit within the previously discussed tray. In this manner, baskets suitable for substantially any size basket designed for consumer use, as well as many baskets sized for the food service industry, may be accommodated by the present invention. This presents the previously described advantage of enabling the shipment of a mixed pallet of differing produce by loading trays optimized for each type of produce onto separate, compatible layers.

Figure 7:
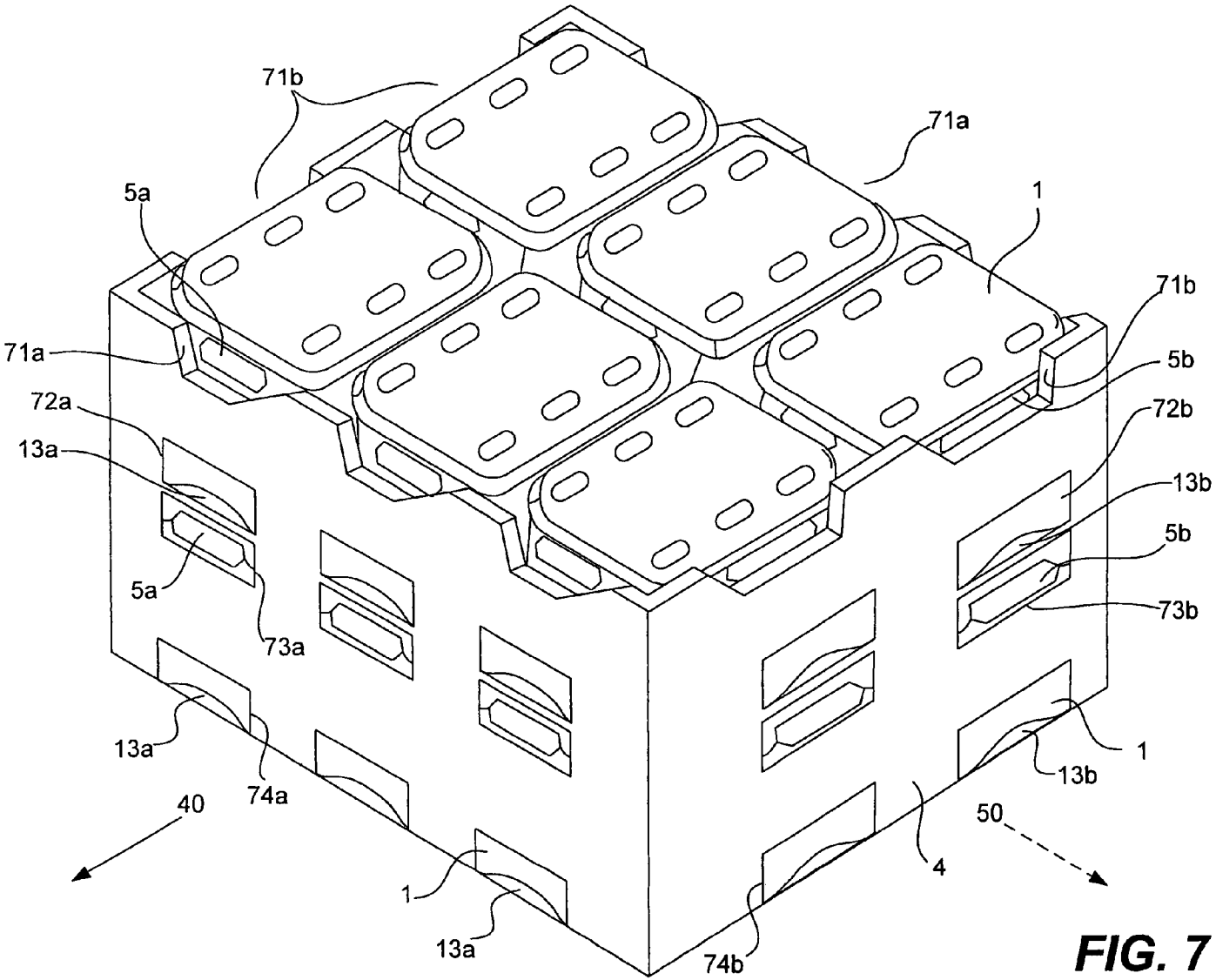
FIG. 7 is a perspective view of a plurality of closed produce baskets loaded into an alternative tray embodiment formed to receive a plurality of baskets arranged in at least two layers.

Moreover, tray embodiments can be constructed to receive a plurality of layers of filled baskets 1. For example, with reference to FIG. 7, one embodiment of the present invention designed to hold two layers of the filled baskets is shown. In this embodiment, twelve baskets 1 are held in the tray 4. The ventilation slots 5*a* and 5*b* of the top layer of baskets 1 are aligned with an uppermost set of vents 71*a* and 71*b*, respectively. The ventilation channels 13*a* and 13*b* of the top layer of baskets 1 are aligned with a set of vents 72*a* and 72*b*, respectively. The ventilation slots 5*a* and 5*b* of a bottom layer of baskets 1 are aligned with another set of vents 73*a* and 73*b*, respectively. Ventilation channels 13*a* and 13*b* for the bottom layer of baskets 1 are aligned with a bottom set of vents 74*a* and 74*b*, respectively. Such a configuration enables bi-directional cooling flows (first cooling flow 40 and second cooling flow 50) to be directed efficiently through the tray 4 in order to effectively cool the contained produce items. In one such embodiment, the first cooling flow 40 and second cooling flow 50 are directed perpendicularly to each other in order to establish bi-directional cooling. Additionally, tray vents (e.g., 71*a*, 71*b*, 72*a*, 72*b*, 73*a*, 73*b*, 74*a*, and 74*b*) may be formed having a number of different shapes and geometries. In one alternative implementation, the middle sets of vents 72*a*, 72*b*, 73*a*, 73*b* can be consolidated such that 72*a* and 73*a* comprise one larger set of vents and 72*b* and 73*b* also make another set of larger vents. Each of the larger vents is configured so that a ventilation slot of the lower layer of baskets and a bottom ventilation channel of a basket of the upper layer of baskets shares the same larger vent.

The tray embodiments can be formed of cut and folded corrugated cardboard formed in a manner well known to those of skill in the art. One such corrugated cardboard is Georgia-Pacific USP120-33sm1-USP120, although any number of packaging materials well known to those of ordinary skill in the art could, with equal facility, be used. Such alternative materials include, but are not limited to, various cardboards, pressboards, flakeboards, fiberboards, plastics, metals and metal foils. In some embodiments, it may further be advantageous to incorporate a gluing, adhesive or fastening step in fabrication of the tray, again in accordance with generally accepted practices in container design and fabrication.

Because of the smaller size of the trays of the present invention, a lighter grade of corrugated board can be used for their manufacture than are trays required to support the greater weight and greater area of the Michigan baskets previously described. This lighter weight not only minimizes shipping costs, but can significantly reduce packaging costs for the shipper, again lowering consumer costs. While the tray of a first preferred embodiment is formed of corrugated cardboard, the principles of the present invention may with equal facility be implemented on a variety of alternative tray materials. Such alternative materials include, but are not limited to, various polymeric and monomeric plastics again including, but not limited to, styrenes, polyethylenes including HDPE and LPDE, polyesters and polyurethanes; metals and foils thereof; paper products including chipboard, pressboard, and flakeboard; wood; wire; and combinations of the foregoing.

Each of the embodiments shown in FIGS. 1-7 enables the flow of cooling air from any side of the tray and basket, with a corresponding outflow of vent from the opposite side of the tray and basket. This in turn enables the positioning of trays, within a given layer, in either perpendicular or parallel orientations with respect to one another, as shown at "X" and "Y" in FIG. 6. This finally enables the previously discussed "5-down" and "10-down" arrangement of trays, currently deemed desirable by the produce and packaging industries.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. In particular, the use of alternative basket forming technologies, tray forming technologies, basket and tray materials and specifications, basket shapes and sizes to conform to differing produce requirements, and vent configurations are all contemplated by the principles of the present invention.

We claim:

1. A produce container comprising:

a produce basket having a basket body and a lid for covering the basket body;

the lid connected to the body with a flexible hinge that enables to container to be opened and closed, the hinge having a plurality of ventilation apertures that enables an airflow to pass into the container when closed; and a plurality of ventilation slots and a plurality of ventilation channels are formed in the container to facilitate the flow of cooling air in at least two transversely oriented directions through the basket and underneath the basket, the ventilation channels formed in a lower portion of the basket.

2. The produce container of claim 1 wherein the basket body comprises a base, a pair of sidewalls, and a pair of endwalls, the base, the pair of sidewalls, and the pair of endwalls being integrally connected; and wherein the lid is hingedly connected to the basket body.

3. The produce container of claim 1 wherein said ventilation aperture formed in the hinge comprises at least one of the plurality of ventilation slots formed in the basket to facilitate the flow of cooling air through the basket.

4. The produce container of claim 1 wherein the plurality of ventilation channels include a first ventilation channel, a second ventilation channel, and a third ventilation channel, wherein the first and second ventilation channels are configured to enable two substantially parallel airflows to pass under the container in a first direction and wherein the third ventilation channel is configured to enable another airflow to pass under the container in a second direction that is transverse with respect the first direction.

5. The produce container of claim 4 wherein the container is configured such that the first and second ventilation channels are configured to enable the two substantially parallel airflows to pass under the container in a first direction that is substantially perpendicular to the second direction enabled by the third ventilation channel.

6. The produce container of claim 1 wherein the basket body has a major axis and a minor axis and wherein the plurality of ventilation channels include a first concave channel, a second concave channel, and a third concave channel, wherein the first and second concave channels are formed in a bottom portion of the basket and extend substantially parallel to the minor axis of the basket and wherein the third concave channel is formed in a bottom portion of the basket and extends substantially parallel to the major axis of the basket.

7. The produce container of claim 6 wherein the plurality of ventilation slots are formed in an upper portion of the container.

8. The produce container of claim 7 wherein the upper portion of the container includes a plurality of ventilation openings.

9. The produce container of claim 8 wherein the plurality of ventilation openings are formed in the lid.

* * * * *

UNITED STATES PATENT AND TRADEMARK OFFICE

CERTIFICATE OF CORRECTION

PATENT NO. : 7,472,799 B2
APPLICATION NO. : 11/207258
DATED : January 6, 2009
INVENTOR(S) : Cadiente et al.

It is certified that error appears in the above-identified patent and that said Letters Patent is hereby corrected as shown below:

| | |
|---|---|
| Col. 2, line 65, | change "(3W)" to --(3 ½")--. |
| Col. 2, line 67 to Col. 3, line 1, | change "(15W"×19%")" to --(15 ½"×19")--. |
| Col. 11, line 32, | change "3 W" to --3 ½"--. |
| Col. 11, line 33, | change "15%" to --15 ¾"--. |
| Col. 11, line 38, | change "6 3/8"×5"×3%" to --6 3/8"×5"×3 ¾"--. |
| Col. 11, lines 39 to 40, | change "16"×13'/4" to --16"×13¼"--. |

Signed and Sealed this
Sixth Day of September, 2011

David J. Kappos

David J. Kappos
*Director of the United States Patent and Trademark Office*